US005905433A

United States Patent [19]

Wortham

[11] Patent Number: 5,905,433

[45] Date of Patent: May 18, 1999

[54] TRAILER COMMUNICATIONS SYSTEM

[75] Inventor: Larry C. Wortham, Garland, Tex.

[73] Assignee: HighwayMaster Communications, Inc., Dallas, Tex.

[21] Appl. No.: 08/758,183

[22] Filed: Nov. 25, 1996

[51] Int. Cl.[6] ..... G08B 21/00

[52] U.S. Cl. ..... 340/431; 340/531; 340/825.06; 307/9.1

[58] Field of Search ..... 340/431, 445, 340/447, 475, 988, 991, 992, 825.06, 825.35, 825.54, 943, 479, 531, 532; 367/118, 127, 128; 307/9.1, 10.1, 10.8; 280/422, 423.1

[56] References Cited

U.S. PATENT DOCUMENTS

| | | | |
|---|---|---|---|
| 3,924,257 | 12/1975 | Roberts | 340/282 |
| 4,065,750 | 12/1977 | Duncan et al. | 340/58 |
| 4,065,751 | 12/1977 | Stewart et al. | 340/58 |
| 4,097,840 | 6/1978 | Chappelle | 340/52 R |
| 4,328,494 | 5/1982 | Goodall | 340/870.18 |
| 4,658,508 | 4/1987 | Oberg | 33/333 |
| 4,679,158 | 7/1987 | Tate | 364/559 |
| 4,682,145 | 7/1987 | Brawner, Jr. | 340/52 H |

(List continued on next page.)

FOREIGN PATENT DOCUMENTS 2659159 9/1991 France .

OTHER PUBLICATIONS

"Transmitter modules serve wireless aplications" advertisement, *RF Monolithics,* Date Unknown, 1 page.

"Product focus: surface acoustic wave (SAW)" advertisement, *Sawtek,* Date Unknown, 1 page.

"Multiplexes Tractor–Trailer Unveiled Demo units may be running in fleets by next year," Source Unknown, Date Unknown, 1 page.

"Preliminary RF Mini Transceiver—900 MHz 'Mini–Link'™," *Data Hunter,* Date Unknown, 2 pages.

"RFM® Virtual Wire® Development Kits" brochure, *RF Monolithics, Inc.,* Date Unknown, 2 pages.

"RF products IC is Single–Chip DSSS Radio System for RFID" advertisement, *Micron Communications Inc.,* Date Unknown, 1 page.

"ID Technologies—All about RFID" Information from the Internet, *RFID Technologies,* Date Unknown, 3 pages.

"ID Technologies—How your business can benefit from RFID" Information from the Internet, *RFID Technologies,* Date Unknown, 2 pages.

"ID Technologies—How to get started with RFID" Information from the Internet, *RFID Technologies,* Date Unknown, 1 page.

(List continued on next page.)

*Primary Examiner*—Jeffery A. Hofsass
*Assistant Examiner*—Van T. Trieu
*Attorney, Agent, or Firm*—Baker & Botts, L.L.P.

[57] ABSTRACT

A trailer communications system (36) is provided. The system (36) includes a trailer transducer unit (22) for location on a trailer (12). A vehicle transducer unit (24) can be located on a vehicle (26, 28, 30) or a stationary object (32). The trailer transducer unit (22) and the vehicle transducer unit (24) may communicate information in the form of acoustic signals broadcast at an ultrasonic frequency in response to a predetermined event.

31 Claims, 6 Drawing Sheets

U.S. PATENT DOCUMENTS

| | | | |
|---|---|---|---|
| 4,688,244 | 8/1987 | Hannon et al. | 379/58 |
| 4,750,197 | 6/1988 | Dennekamp et al. | 379/58 |
| 4,780,618 | 10/1988 | Wareman et al. | 307/9 |
| 4,784,403 | 11/1988 | Hawkins et al. | 280/432 |
| 4,797,948 | 1/1989 | Milliorn et al. | 455/54 |
| 4,804,937 | 2/1989 | Barbiaux et al. | 340/52 F |
| 4,831,539 | 5/1989 | Hagenbuch | 701/207 |
| 4,851,822 | 7/1989 | Barnett | 340/635 |
| 4,884,208 | 11/1989 | Marinelli et al. | 701/300 |
| 4,897,642 | 1/1990 | DiLullo et al. | 340/825.6 |
| 4,943,798 | 7/1990 | Wayne | 340/443 |
| 4,952,908 | 8/1990 | Sanner | 340/429 |
| 4,955,000 | 9/1990 | Nastrom | 367/117 |
| 4,988,974 | 1/1991 | Fury et al. | 340/431 |
| 5,008,859 | 4/1991 | Cyr | 367/2 |
| 5,025,253 | 6/1991 | DiLullo et al. | 340/825.06 |
| 5,068,654 | 11/1991 | Husher | 340/903 |
| 5,090,779 | 2/1992 | Kramer | 303/7 |
| 5,142,278 | 8/1992 | Moallemi et al. | 340/825.06 |
| 5,191,328 | 3/1993 | Nelson | 340/870.06 |
| 5,204,819 | 4/1993 | Ryan | 364/465 |
| 5,278,563 | 1/1994 | Spiess | 342/44 |
| 5,282,641 | 2/1994 | McLaughlin | 280/432 |
| 5,289,160 | 2/1994 | Fiorletta | 340/447 |
| 5,306,953 | 4/1994 | Weiner | 307/10.1 |
| 5,347,274 | 9/1994 | Hassett | 340/988 |
| 5,373,482 | 12/1994 | Gauthier | 367/99 |
| 5,374,918 | 12/1994 | Tharbs | 340/438 |
| 5,397,924 | 3/1995 | Gee et al. | 307/9.1 |
| 5,434,552 | 7/1995 | Ems | 340/431 |
| 5,436,612 | 7/1995 | Aduddell | 340/438 |
| 5,442,343 | 8/1995 | Cato et al. | 340/825.35 |
| 5,442,810 | 8/1995 | Jenquin | 455/66 |
| 5,453,932 | 9/1995 | Brabec | 701/50 |
| 5,455,557 | 10/1995 | Noll et al. | 340/431 |
| 5,477,207 | 12/1995 | Frame, Sr. et al. | 340/431 |
| 5,483,965 | 1/1996 | Wiener et al. | 128/661.03 |
| 5,488,352 | 1/1996 | Jasper | 340/431 |
| 5,506,584 | 4/1996 | Boles | 342/42 |
| 5,513,111 | 4/1996 | Wortham | 701/300 |
| 5,519,621 | 5/1996 | Wortham | 701/300 |
| 5,528,232 | 6/1996 | Verma et al. | 340/825.54 |
| 5,539,810 | 7/1996 | Kennedy, III et al. | 379/59 |
| 5,541,604 | 7/1996 | Meier | 342/42 |
| 5,544,225 | 8/1996 | Kennedy, III et al. | 379/59 |
| 5,550,548 | 8/1996 | Schuermann | 342/42 |
| 5,615,229 | 3/1997 | Sharma et al. | 381/68.2 |
| 5,677,667 | 10/1997 | Lesesky et al. | 340/431 |
| 5,686,902 | 11/1997 | Reis et al. | 340/825.54 |

OTHER PUBLICATIONS

"ID Technologies—What's new at ID Technologies" Internet Information, *RFID Technologies,* Date Unknown, 1 page.

"Telematics Applications Programme" Brochure, *Promote—Chauffeur,* Date Unknown, 7 pages.

"Track Vending Inventory Wirelessly," *Electronic Design,* Dec. 4, 1995, 1 page.

"CRL Creating the future" Brochure, *Central Research Laboratories Limited,* 1996, 4 pages.

"MicroStamp Engine™ Modulated Backscatter (MBS) Version Preliminary Data Sheet," *Micron Communications, Inc.,* 1996, 18 pages.

Roy Tarantino, "Adding Wireless Communication Capability to Embedded Systems," *Embedded Systems Programming,* Feb., 1996, 12 pages.

Richard Pell, Jr., "Wireless communications chip aims to expand RFID market," *Electronic Products,* Mar., 1996, 1 page.

Jim Mele, "Smart Trucks," *Fleet Owner,* Jun. 1996, 3 pages.

Stewart Siegel, "Smart Trailers," *Fleet Owner,* Jun., 1996, 4 pages.

Tom Moore, Smart Shops, *Fleet Owner,* Jun., 1996, 4 pages.

Robert Keenam, "Engine and Simulator Drive Low–Power 2.4–GHz RFID System," *Wireless Systems Design,* Aug., 1996, 2 pages.

"Navigato International Announces Tailtag™" TruckNet—Trucking News Internet Information, *Sziener Interactive,* Apr. 12, 1996, 1 page.

Robert Deierlein, "What Kind of Name is 'TruckMux'?," *Private Carrier,* Oct., 1996, 2 pages.

"Integrated RF and Digital Solutions for Remote Keyless Entry," *Showcase,* Oct., 1996, 2 pages.

*IDSystems* Catelog page, Dec., 1996, 1 page.

"Connector Warning," *Heavy Duty Trucking,* Jan., 1997, 1 page.

24

120
TEST
VDD 142
140
118
MICROPROCESSOR
VDD
/IRQ/VPP
PA0
PA1
PA2
PA3
PA4
PA5
PA6
PA7
PB0
PB1
PB2
PB3
PB4
PB5
OSC 1
OSC 2
VSS
/RESET
128
TRANSMIT
TRANSMIT OUT
218
220
VDD
136
TO FIG. 4B
122
OSCILLATOR
148
146
144
150
123
VDD
145
147
POWER-UP RESET
138
POWER SUPPLY
222
226
224
IN
OUT
GND
230
228
232
234
VDD
TRIGGER
130
VDD
208
206
204
198
210
202
200
196
TRIGGER SIGNAL

24

TRAILER COMMUNICATIONS SYSTEM

TECHNICAL FIELD OF THE INVENTION

This invention relates generally to the field of data communications, and more particularly to a trailer communications system.

BACKGROUND OF THE INVENTION

In recent years, due to their versatility, trailers have evolved as a preferred way to move goods from one location to another. For example, trailers can be carried or transported in a number of ways, such as over roadways by tractor, over railways on the back of rail cars, or over waterways by ships or barges. In addition, various devices, such as refrigeration units, humidifiers, and anti-shock devices, can be incorporated into trailers for the transport of different products, such as perishable foods, electronics, antiques, chemicals, and the like.

In order to monitor, track, control, or otherwise manage such trailers, it is often desirable to communicate with the trailers during transport. Accordingly, various systems were previously developed for transmitting and receiving information from a trailer. These prior systems have proven to be inadequate for one reason or another. For example, despite the presence of the prior systems, trailers were often misplaced or lost. This was especially problematic at any location where the mode of transportation was altered, such as a shipping yard. Also, in prior systems, the kind and amount of information communicated to and from trailers was extremely limited. In addition, prior systems did not consolidate information from a plurality of trailers at a central location, but rather supported communication only proximate each individual trailer, such as in a vehicle transporting the trailer. Furthermore, some prior systems employed techniques, such as the broadcast of signals at radio frequencies, which generated "cross-talk." Cross-talk occurs when one receiving device receives and processes signals which are intended for another receiving device. Radio frequency techniques also required approval by a regulatory agency, such as the Federal Communications Commission (FCC).

SUMMARY OF THE INVENTION

In accordance with the present invention, the disadvantages and problems associated with prior communications systems for trailers have been substantially reduced or eliminated.

According to an embodiment of the present invention, a trailer communications system is provided. The system includes a trailer transducer unit for location on a trailer. A vehicle transducer unit can be located on a vehicle. The trailer transducer unit and the vehicle transducer unit may communicate information in the form of acoustic signals broadcast at an ultrasonic frequency in response to a predetermined event.

According to another embodiment of the present invention, a trailer communications system includes a trailer transducer unit for location on a trailer. The trailer transducer unit stores trailer identification information uniquely identifying the trailer. The trailer transducer unit can transmit the trailer identification information in the form of an acoustic signal broadcast at an ultrasonic frequency in response to a predetermined event. A vehicle transducer unit, for location on a vehicle, may receive the trailer identification information transmitted by the trailer transducer unit.

According to yet another embodiment of the present invention, a system is provided for communication between a trailer and a vehicle. The system includes a trailer transducer unit located on the trailer. The trailer transducer unit comprises a trigger circuit, a first microprocessor, and a first ultrasonic transducer. The trigger circuit is operable to detect a predetermined event. The first microprocessor, coupled to the trigger circuit, generates an electrical signal in response to the detection of the predetermined event. The first ultrasonic transducer is coupled to the first microprocessor. The first ultrasonic transducer may convert the electrical signal generated by the first microprocessor into an acoustic signal, and then transmit the acoustic signal at an ultrasonic frequency. The system also includes a vehicle transducer unit located on the vehicle. The vehicle transducer unit comprises a second ultrasonic transducer and a second microprocessor. The second ultrasonic transducer receives the acoustic signal transmitted by the first ultrasonic transducer of the trailer transducer unit, and converts the acoustic signal into an electrical signal. The second microprocessor is coupled to the second ultrasonic transponder. The second microprocessor processes the electrical signal from the second ultrasonic transducer.

Important technical features of the present invention include utilizing acoustic transponders broadcasting at ultrasonic frequencies for communicating to and from a trailer. These acoustic transponders transmit signals effectively only at a relatively short distance and within a relatively small arc of direction. Consequently, the acoustic transponders of the present invention substantially reduce or eliminate the problem of cross-talk. Also, because these transponders operate at ultrasonic frequencies rather than radio frequencies, there is no need to obtain the approval of the FCC. Furthermore, the acoustic transponders can be used to determine the distance between two objects.

Another technical advantage of the present invention includes synchronizing the transmission and receipt of information when communicating between a trailer and a vehicle. Synchronization can be supported by a standard seven-pin connector and may be accomplished using an event, such as the application of brakes, that may occur simultaneously on both the trailer and the vehicle. After such event occurs, a window of time is provided. All signals received during this window of time are considered to convey "valid" information. All other signals are considered to convey "invalid" information. Synchronization thus ensures that interference, spurious signals, cross-talk, and the like are not processed in the same manner as signals which are intended for receipt.

Yet another technical advantage of the present invention includes communicating a variety of information at a trailer. This information may include trailer identification, status, alarm, and control information, all of which can be transmitted to or received from a central host. In addition, position determining information can be generated proximate the trailer and relayed to the central host. Consequently, the monitoring, control, tracking, or management of the trailer is facilitated.

Yet another technical advantage includes providing a separate vehicle transducer unit on each vehicle which transports a trailer and at each site at which the trailer may be stored. A trailer transducer unit, provided on the trailer, may communicate with these vehicle transducer units. In this manner, the present invention supports the capability to communicate with a trailer at any moment during transport.

Other technical advantages are readily apparent to one skilled in the art from the following figures, description, and claims.

BRIEF DESCRIPTION OF THE DRAWINGS

For a more complete understanding of the present invention, and for further features and advantages, reference is now made to the following description taken in conjunction with the accompanying drawings, wherein like reference numerals represent like parts, in which.

DETAILED DESCRIPTION OF THE INVENTION

The present invention and its advantages are best understood by referring to FIGS. 1–6 of the drawings, like numerals being used for like and corresponding parts of the various drawings.

Figure 1:
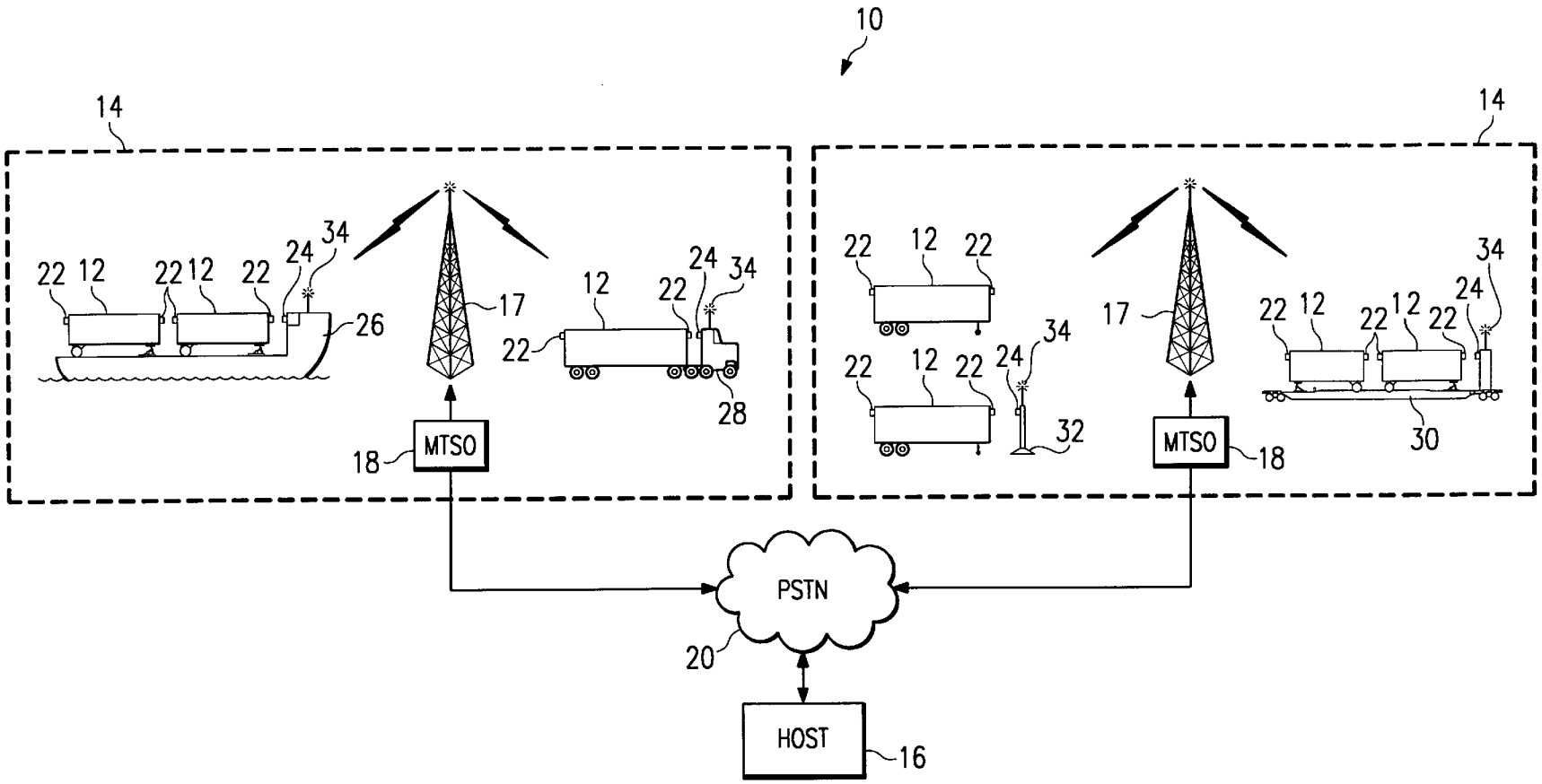
FIG. 1 illustrates a network for communicating information associated with various trailers in accordance with the teachings of the present invention.

FIG. 1 illustrates a network 10 for communicating information from one or more trailers 12 in accordance with the teachings of the present invention. As shown, network 10 may include one or more cellular systems 14 which are linked to a host 16. Each of these cellular systems 14 may have a specific area of coverage over which it operates. Each cellular system 14 may comprise a transmitter 17 coupled to a mobile telephone switching office (MTSO) 18. Each MTSO 18 may be coupled to a public switched telephone network (PSTN) 20, which is coupled to host 16. In other embodiments, network 10 may include any other suitable communication system, such as a specialized mobile radio (SMR) system or a personal communication service (PCS). Furthermore, network 10 may comprise of one or more land-based transmission towers, spaced-based satellite transponders, or a combination of communications hardware in space or on land. Transmissions over network 10 may be analog or digital without departing from the scope of the invention.

Host 16 performs the management and control functions for one or more trailers 12. The present invention contemplates that network 10 may include one or more hosts 16 associated with a trucking company, a delivery company, or any other entity which operates, owns, uses, or otherwise manages trailers 12. Host 16 may receive various information relating to trailers 12 over network 10. As explained below in more detail, this information may include trailer identification information, status information, alarm information, positioning information, or any other suitable information. Furthermore, various information can be generated at host 16 and then transmitted to trailers 12. Such information may include control information for trailers 12, also explained below. Accordingly, information received from and transmitted to a plurality of trailers 12 can be consolidated, input, reported, or displayed at a central location in order to facilitate management, tracking, and control of the trailers 12.

Each trailer 12 generally functions to contain and transport cargo from one location to another. In some cases, this cargo can be sensitive to one or more containment or transport conditions, such as humidity, pressure, temperature, shock, and the like. For example, trailers 12 can be used to carry perishable goods, chemicals, explosives, artifacts, or any other cargo which is sensitive to containment or transport conditions. Consequently, various conditioning devices, such as refrigeration units, humidifiers, and anti-shock devices, can be incorporated into trailers 12 to maintain conditions within certain critical levels during transport so that sensitive cargo is not damaged, ruined, harmed, or destroyed.

Each trailer 12 may be equipped with one or more trailer transducer units 22, which can be mounted on an external surface of the trailer. In one embodiment, a separate trailer transducer unit 22 may be provided at each of the front and the rear of a trailer 12. Each trailer transducer unit 22 may support a number of functions. For example, each trailer transducer unit 22 may support ranging (i.e., the determination of distance) between a trailer 12 and any other object, such as a vehicle or a loading dock.

Furthermore, trailer transducer units 22 can function to generate, transmit, or receive various information. Information which may be generated and/or transmitted by a trailer transducer unit 22 includes identification information, status information, alarm information, or any other suitable information relating to a trailer 12. Identification information may specify an alphanumeric code, a name, or any other appropriate information for uniquely identifying a trailer 12. Status information may comprise current readings for various environmental conditions on board a trailer 12, such as temperature, humidity, pressure, shock, or the like. Status information may also specify the status of other conditions on a trailer 12, such as the fact that all doors on the trailer are secured. Alarm information may include information for alerting an operator, such as the driver of a vehicle, when conditions exceed or fall below the specified critical levels. Furthermore, the alarm information may also identify any of a number of other events which may occur on trailer 12, such as the opening of a door. The information received by trailer transducer units 22 may include control information which can, for example, be used to update or adjust specified critical levels on board a trailer 12.

A separate vehicle transducer unit 24 may communicate with each trailer transducer unit 22. Vehicle transducer units 24 may be carried on board any vehicle operable to transport one or more trailers 12, including tractors, airplanes, boats, barges, ships, and rail cars. As illustrated in FIG. 1, exemplary vehicles include a ship 26, a tractor 28, and a rail car 30. Vehicle transducer units 24 can also be mounted on a stationary object, such as a stand 32, which may be located at any site where trailers 12 are stored or switched between various vehicles. Accordingly, whenever a trailer 12 is separated from one vehicle and either stored or, alternatively, coupled to or transported by another vehicle, a vehicle transducer unit 24 may be provided to support communication with trailer transducer unit 22 on board the trailer. It should be understood that whenever two or more trailers are coupled together or located end-to-end, the trailer transducer unit 22 on the front of one trailer 12 can be in communication with a trailer transducer unit 22 mounted on the rear of another trailer 12 in substantially the same manner as communication between a trailer transducer unit 22 and a vehicle transducer unit 24.

Communication between a trailer transducer unit 22 and a corresponding vehicle transducer unit 24 can be initiated upon the occurrence of any of a number of predetermined events, such as a synchronization event, an alarm event, or the lapsing of a predetermined interval. A synchronization event may comprise any event which may occur substantially simultaneously on both trailer 12 and tractor 28. A synchronization event can be supported by a standard seven-pin connector 29 between a trailer 12 and a tractor 28. Such a seven-pin connector 29 typically is used to coordinate electrical components on a tractor 28 and a trailer 12, such as brake lights, turn lights, flashers, and the like, so that the tractor/trailer combination can be operated safely and effectively. The synchronization event may comprise the detection of a signal over the seven-pin connector 29, or alternatively, the coupling/decoupling of the trailer end of a seven-pin connector 29 to/from the vehicle end of the connector. Synchronization ensures each of trailer transducer unit 22 and vehicle transducer unit 24 that it is communicating with the appropriate unit. An alarm event may occur when sensors 39 detect that one or more conditions have exceeded or fallen below predetermined critical levels. The periodic interval can be every fifteen minutes, half of an hour, hour, or any other suitable interval.

A relay unit 34 may be coupled to and located proximate each vehicle transducer unit 24. Relay units 34 can relay all of the various information described above between host 16 and trailers 12. An exemplary embodiment of this functionality is described in U.S. Pat. No. 5,544,225 issued on Aug. 6, 1996, to Kennedy, III et al., entitled "Data Messaging In a Cellular Communications Network," the entire disclosure of which is specifically incorporated herein by reference. Relay units 34 may also comprise interfaces 35 (FIG. 2) which support the entry and presentation of information on board a vehicle. In one embodiment, each relay unit associated with a transducer unit 24 mounted on a stationary object may contain positioning information specifying the geographic position of the stationary object. Each relay unit 34 associated with a transducer unit 24 mounted on a vehicle may include a mobile position receiver operable to receive position determining information from a positioning system. In general, a positioning system comprises a plurality of spaced-based or land-based transmitters that emit information which can be used to determine position. The position determining information comprises accurate position and pseudo-range data represented by the time of arrival of position determining information from a positioning system to relay unit 34. A positioning system may be implemented as land-based LORAN-C, a space-based GPS, a dead reckoning system, an inertial navigation system, or any other appropriate positioning technology.

In operation, trailers 12 can be used to transport cargo within or between the coverage areas of cellular systems 14 in network 10. During transport, information relating to trailers 12 can be sent to and received from host 16. In particular, each trailer transducer unit 22 communicates with a corresponding vehicle transducer unit 24. Because a separate vehicle transducer unit 24 may be provided on each vehicle which transports a particular trailer 12 and at each site at which such trailer 12 may be stored, the present invention supports communication with trailers 12 at any moment during transport. Communication between a trailer transducer unit 22 and a corresponding vehicle transducer unit 24 may be initiated upon the occurrence of a synchronization event, an alarm event, or the lapse of the predetermined interval.

In some cases, trailer transducer unit 22 may transmit information, such as status information, identification information, and alarm information to the corresponding vehicle transducer unit 24. This information can be displayed on the interface of relay unit 34, which may also relay the information along with position determining information to host 16. In other cases, vehicle transducer unit 24 may transmit information generated at host 16, such as control information, to trailer transducer unit 22. Accordingly, the present invention facilitates the monitoring, tracking, control, or management of trailers 22 at host 16. For example, the position determining information and trailer identification information received at host 16 allows the host to locate each trailer 12, thereby eliminating or substantially reducing the problem of trailers being lost or misplaced.

Also in operation, each trailer transducer unit 22 may be used to support ranging for trailers 12. For example, in the case where a tractor 28 is being hooked up to a trailer 12, the trailer transducer unit 22 on board trailer 12 may be used to determine the distance between trailer 12 and the tractor 28. Consequently, the present invention facilitates the positioning or movement of trailer 12. The ranging feature is described below in more detail with reference to FIGS. 4A and 4B.

Figure 2:
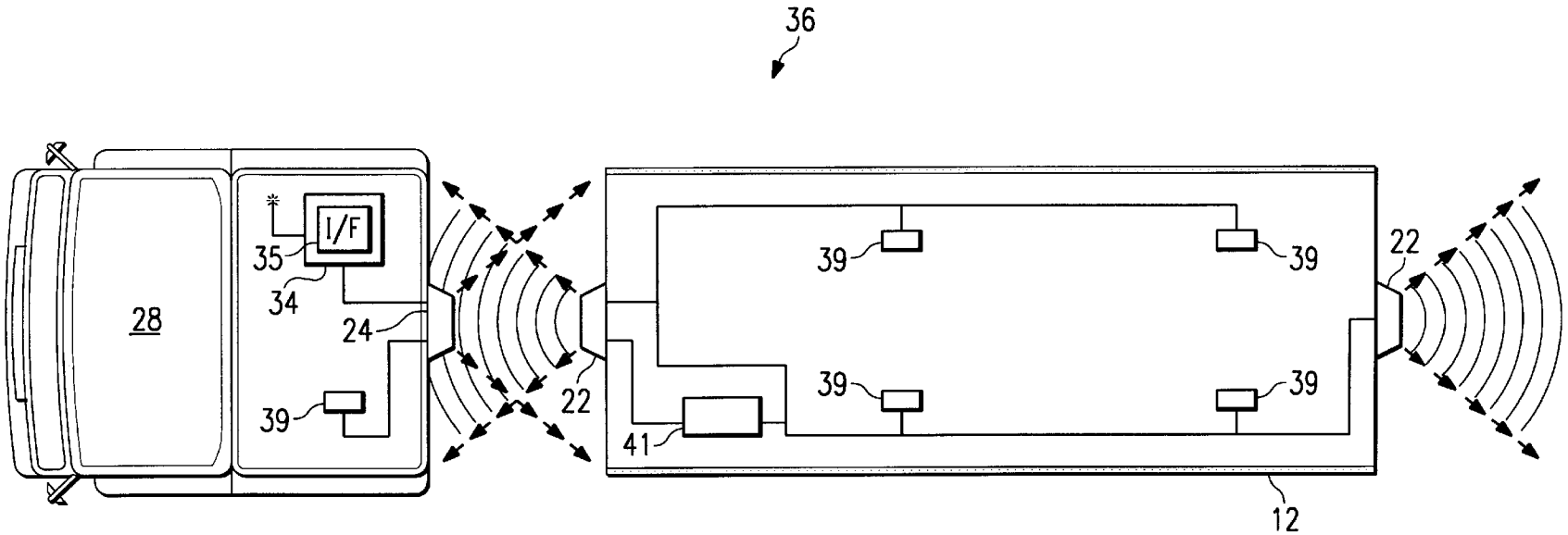
FIG. 2 illustrates a system for communicating information from a trailer in accordance with the teachings of the present invention.

FIG. 2 illustrates a system 36 for communicating information from a trailer 12 to a vehicle, such as an exemplary tractor 28. System 36 may include at least one trailer transducer unit 22, a vehicle transducer unit 24, a relay unit 34, one or more sensors 39, and a control unit 41.

As described above, trailer transducer unit 22 may provide ranging and the generation, transmission, and/or receipt of various information relating to trailer 12, including trailer identification, status, and alarm information. An exemplary embodiment of trailer transducer unit 22 is illustrated and described in more detail below with reference to FIG. 3. Vehicle transducer unit 24 communicates with trailer transducer unit 22. An exemplary embodiment of vehicle transducer unit 24 is illustrated and described below in more detail with reference to FIGS. 4A and 4B.

To support their respective functions, each of trailer transducer unit 22 and vehicle transducer unit 24 may comprise an acoustic transducer. Preferably, the acoustic transducers operate at an ultrasonic frequency. These acoustic transducers may transmit signals effectively only at a relatively short distance, typically in the range of ten to fifteen feet, and in a limited arc of direction, typically between sixty to one hundred degrees. Because of the limited effective distance and arc of transmission, the opportunity for cross-talk is substantially reduced or eliminated. That is, each trailer transducer unit 22 and vehicle transducer unit 24 will most likely be able to communicate only with an intended corresponding unit. Furthermore, because the acoustic transponders preferably operate at ultrasonic frequencies rather than radio frequencies, there is no need to obtain the approval of a regulatory agency, such as the Federal Communications Commission (FCC).

Sensors 39 may be located on trailer 12 and tractor 28 and coupled to trailer transducer unit 22 and vehicle transducer unit 24, respectively. Sensors 39 support the generation of status and alarm information by the transducer units 22 and 24. Sensors 39 may include thermometers, barometers, accelerometers, and other sensors for detecting the temperature, humidity, pressure, shock, or any other environmental conditions which may affect cargo within trailer 12. Such sensors 39 provide up-to-date readings to trailer transducer unit 22. Sensors 39 may also include sensors operable to detect the occurrence of other events on board trailer 12 or tractor 28, such as the opening of a door or the communication of signals across a seven-pin connector 29 between trailer 12 and tractor 28. For example, at least one sensor 39 on each of trailer 12 and tractor 28 may be coupled to the seven-pin connector wiring used to support the brake lights, the signal lights, the flashers, or the like. The seven-pin connector 29 sensor may support the synchronization of communication between trailer transducer unit 22 and vehicle transducer unit 24. The door-opening sensor may support the generation of an alarm to alert an operator of the undesired opening of a door.

Control unit 41 may be located on trailer 12 and coupled to trailer transducer unit 22 and sensors 39. Control unit 41 generally functions to monitor and/or adjust environmental conditions within trailer 12. For example, control unit 41 may comprise the controls for a refrigeration unit operable to change the temperature within trailer 12. Likewise, control unit 41 may include controls for a humidifier operable to change the humidity within trailer 12. Control unit 41 may be responsive to signals or information, such as control information, received from sensors 39 and trailer transducer unit 22. Control unit 41 may comprise a memory which, over time, functions to store the information relating to conditions and controls. Accordingly, this information can be reported or relayed at some time subsequent to its collection.

As previously described, relay unit 34 can be coupled to vehicle transducer unit 24 and may include an interface (I/F) 35. The functionality of interface 35 can be performed by one or more suitable input devices, such as a keypad, touch screen, or other suitable device that can accept information, and one or more suitable output devices, such as a computer display, for conveying information associated with the operation of communicating system 36, including digital data, visual information, or audio information. Among other functions, interface 35 allows an operator on board tractor 28 to monitor and adjust conditions in trailer 12.

In operation, sensors 39 and control unit 41 monitor conditions (e.g., humidity, pressure, shock, and the like) and events (e.g., application of brakes or opening of a door) on board trailer 12 and tractor 28. Trailer transducer unit 22 uses the readings taken by sensors 39 and control unit 41 to generate status and alarm information, which can be transmitted to and relayed by corresponding vehicle transducer unit 24. Furthermore, vehicle transducer unit 24 may also transmit control information to trailer transducer unit 22. The control information may cause control unit 41 to adjust the conditions on board trailer 12. The detection of any signal over a seven-pin connector 29 (e.g., a brake signal, turn signal, flashing signal, or the like) by sensors 39 on board both trailer 12 and tractor 28 may constitute a synchronization event, as previously described, which synchronizes the transmission and receipt of information between trailer transducer unit 22 and vehicle transducer unit 24.

Figure 3:
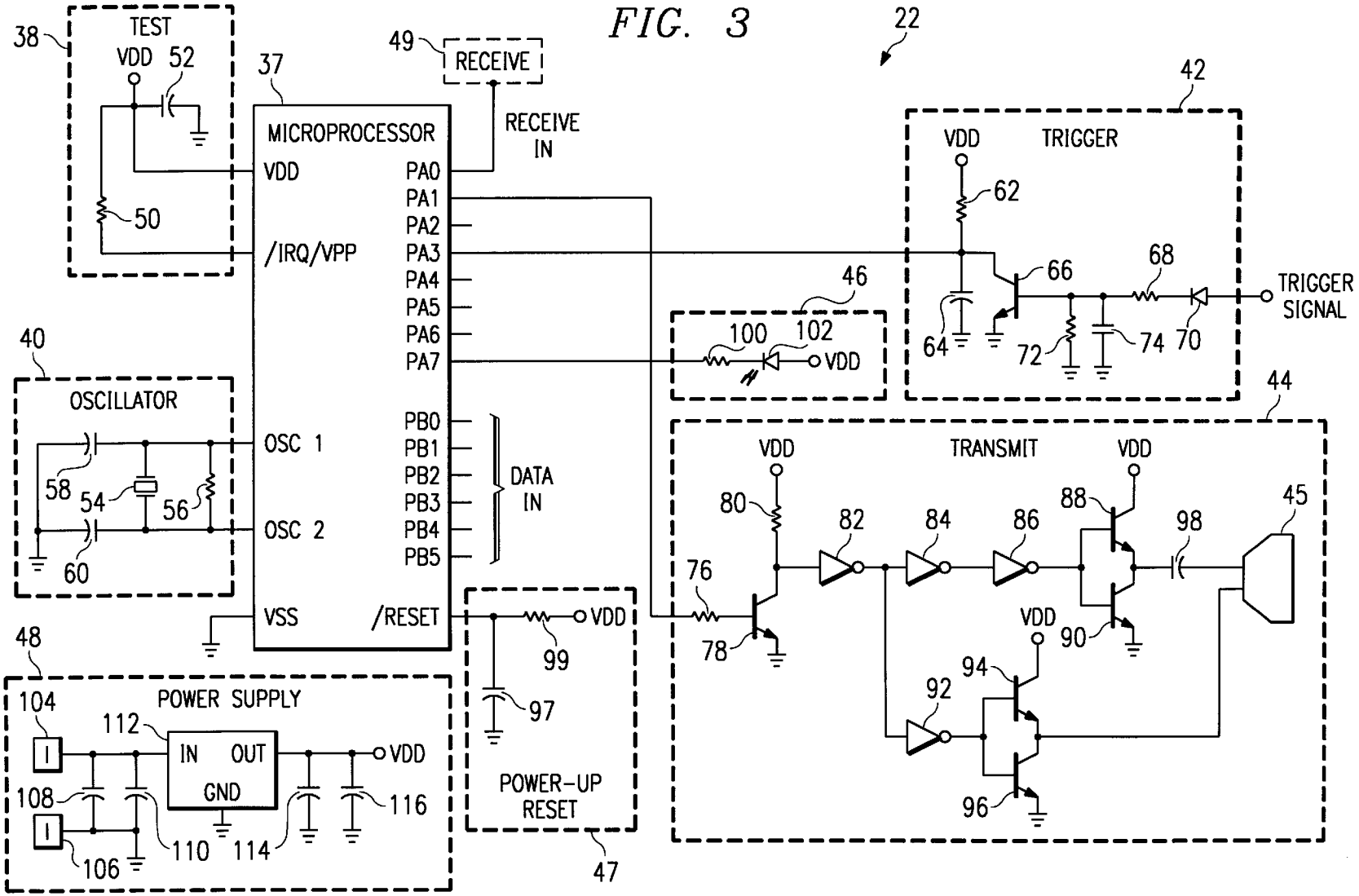
FIG. 3 is a schematic diagram for an exemplary embodiment of a trailer transducer unit.

FIG. 3 is a schematic diagram of an exemplary embodiment of trailer transducer unit 22. Trailer transducer unit 22 can be located on a trailer 12. As shown, trailer transducer unit 22 may include a microprocessor 37, a test circuit 38, an oscillator circuit 40, a trigger circuit 42, a transmit circuit 44 having an ultrasonic transducer 45, a transmit/receive indicator circuit 46, a power-up reset circuit 47, a power supply circuit 48, and a receive circuit 49.

Microprocessor 37 may be implemented as any suitable microprocessor, such as a model MC68HC705J1A microprocessor manufactured by MOTOROLA. Microprocessor 37 controls the operation of trailer transducer unit 22. Microprocessor 37 may include internal memory for storing data or software. The software may specify various critical levels for conditions on-board a trailer 12, according to the cargo being transported. For example, the software can specify an upper control temperature of 40° F. and a lower control temperature of -30° F. if the cargo comprises frozen foods. Similarly, the software can specify particular upper and lower humidity levels for tobacco products, such as cigars. Microprocessor 37 is operable to run the software. Microprocessor 37 may generate one or more signals, in electrical form, to be output by trailer transducer unit 22. Microprocessor 37 may also receive various signals, such as from one or more sensors 39 and control unit 41 located on-board trailer 12 at a plurality of inputs (i.e., PB0–PB5). The information conveyed by the input signals may include both status and alarm information. A VSS input of microprocessor 37 may be coupled to ground.

Test circuit 38 is coupled to microprocessor 37. Test circuit 38 functions to test trailer transducer unit 22. Test circuit 38 may be implemented as a resistor 50 coupled between an IRQ/VPP and a VDD input of microprocessor 37. Resistor 50 may have a value of 10 kΩ. A voltage source (VDD), described below, is also coupled to the VDD input. A capacitor 52 is coupled between the voltage source and ground. Capacitor 52 may have a value of 0.1 μF.

Oscillator circuit 40 is coupled to microprocessor 37. Oscillator circuit 40 provides a signal to microprocessor 37. Oscillator circuit 40 may be implemented as a piezoelectric crystal 54 coupled in parallel to a resistor 56 between inputs OSC1 and OSC2. Piezoelectric crystal 54 may operate at four MHz. Resistor 56 may have a value of 10MΩ. Capacitors 58 and 60 are coupled between opposing ends of piezoelectric crystal 54 and ground. Capacitors 58 and 60 may each have a value of 27 pF.

Trigger circuit 42 is also coupled to microprocessor 37. Trigger circuit 42 functions generally to receive and "clean up" or condition a trigger signal, such as a brake signal, turn signal, or flashing signal, so that such signal can be input into microprocessor 37. This trigger signal can be used to synchronize transmission or receipt of information between trailer transducer unit 22 and a vehicle transducer unit 24. Trigger circuit 42 may be coupled to the wiring of a seven-pin connector. Trigger circuit 42 may be implemented as a resistor 62 coupled between the voltage source and an input PA3 of microprocessor 37. Resistor 62 may have a value of 10 kΩ. A capacitor 64, which may have a value of 0.1 μF, can be coupled between the same input and ground. The collector of a transistor 66 may also be coupled to input PA3. The emitter of transistor 66 is coupled to ground. One end of a resistor 68 is coupled to the base of transistor 66. Resistor 68 may have a value of 10 kΩ. A diode 70 is coupled between the other end of resistor 68 and the trigger signal. A resistor 72 and a capacitor 74 are coupled in parallel between the base of transistor 66 and ground. Resistor 72 may have a value of 10 kΩ, and capacitor 74 may have a value of 0.1 μF.

Transmit circuit 44 functions to drive the electrical signals generated by microprocessor 37 for output out of trailer transducer unit 22. Transmit circuit 44 may be implemented as a resistor 76, one end of which is coupled to an output PA1 of microprocessor 37. The other end of resistor 76, which can have a value of 10 kΩ, may be coupled to the base of a transistor 78. The emitter of transistor 78 is coupled to ground. A resistor 80 is coupled between the voltage source and the collector for transistor 78. Resistor 80 may have a value of 10 kΩ. A number of amplifiers 82–86 are coupled in cascading arrangement between the collector of transistor 78 and the bases of transistors 88 and 90. The collector of transistor 88 is coupled to the voltage source and the emitter of transistor 88 is coupled to the collector of transistor 90. The emitter of transistor 90 is coupled to ground. The input of an amplifier 92 is coupled to the output of amplifier 82. The output of amplifier 92 is coupled to the bases of transistors 94 and 96. The collector of transistor 94 is coupled to the voltage source and the emitter of transistor 94 is coupled to the collector of transistor 96. The emitter of transistor 96 is coupled to ground. A capacitor 98 is coupled between the emitter of transistor 88 and one input of ultrasonic transducer 45. Capacitor 98 may have a value of 0.1 $\mu$F. Another input of ultrasonic transducer 45 is coupled to the emitter of transistor 94.

Ultrasonic transducer 45 functions primarily to convert and transmit electrical signals, which are generated by microprocessor 37 and driven by the remainder of transmit circuit 44, into acoustic signals. Ultrasonic transducer 45 can be implemented as an acoustic transducer, which may operate at forty kHz, seventy kHz, or any other suitable ultrasonic frequency. Typically, a transducer operating at ultrasonic frequency may have a sixty degree to one hundred degree arc of transmitting direction.

Transmit/receive indicator circuit 46 may be implemented as a resistor 100 and a diode 102 coupled between an output PA7 of microprocessor 37 and the voltage source. Resistor 100 may have a value of 330Ω. Diode 102 may comprise a light emitting diode (LED). Transmit/receive indicator circuit 46 functions to emit a visible signal whenever trailer transducer unit 22 is either transmitting or receiving information.

Power-up reset circuit 47 is coupled to microprocessor 37. Power-up reset circuit 47 functions to reset trailer transducer unit 22 whenever transducer unit 22 is "powered-up." Power-up reset circuit 47 may be implemented as a resistor 99 coupled between a RESET input of microprocessor 37 and the voltage source. Resistor 99 may have a value of 100 kΩ. A capacitor 97 is coupled between the RESET input and ground. Capacitor 97 may have a value of 0.1 $\mu$F.

Power supply circuit 48 reduces a twelve volt signal, which may be supplied by a vehicle battery, and regulates such twelve volt signal down to a five volt signal. Accordingly, power supply circuit 48 functions as a five volt power source. Power supply circuit 48 is coupled to various elements throughout trailer transducer unit 22. Power supply circuit 48 may be implemented as a connector 104 and a connector 106. Connectors 104 and 106 function to connect power supply circuit 48 to an external battery, such as the vehicle battery. Capacitors 108 and 110 are coupled in parallel between connectors 104 and 106. Capacitors 108 and 110 may have values of 100 $\mu$F and 0.01 $\mu$F, respectively. The input of a voltage regulator 112 is coupled to connector 104. The output of voltage regulator 112 serves as the voltage source. Capacitors 114 and 116 are coupled between the output of voltage regulator 112 and ground. Capacitors 114 and 116 may have values of 10 $\mu$F and 0.1 $\mu$F, respectively.

Receive circuit 49 provides a RECEIVE IN signal for an input PA0 of microprocessor 37. With receive circuit 49, trailer transducer unit 22 can support bidirectional communication with a corresponding vehicle transducer unit 24. That is, trailer transducer unit 22 may be operable to receive input from the corresponding vehicle transducer unit 24 in addition to transmitting output to such transducer unit 24. Receive circuit 49 may be implemented in substantially the same way as receive circuit 126 shown and described with reference to FIG. 4B.

Transmit circuit 44 and receive circuit 49 can be used in combination to support ranging—i.e., determination of distance—between trailer 12 and another object. Specifically, acoustic signals can be broadcast from acoustic transducer 45 of transmit circuit 44. If such signals encounter the object and are reflected back toward trailer transducer unit 22, an acoustic transducer of receive circuit 49 may receive such signals. Microprocessor 37 may be used to time the interval between transmission and receipt of signals so that the distance from the object can be determined.

Figure 4A:
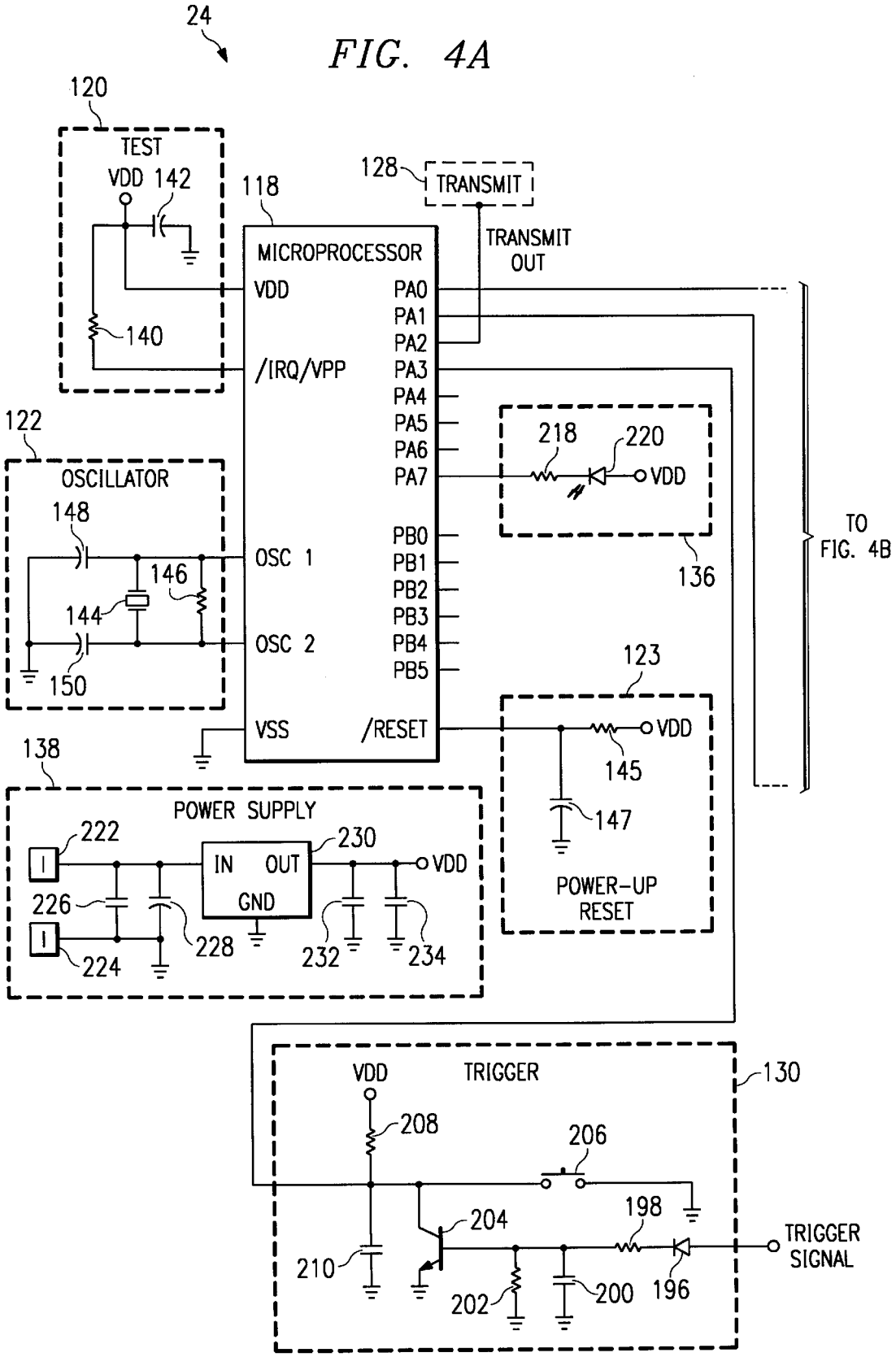
FIGS. 4A and 4B are a schematic diagram for an exemplary embodiment of a vehicle transducer unit.
Figure 4B:
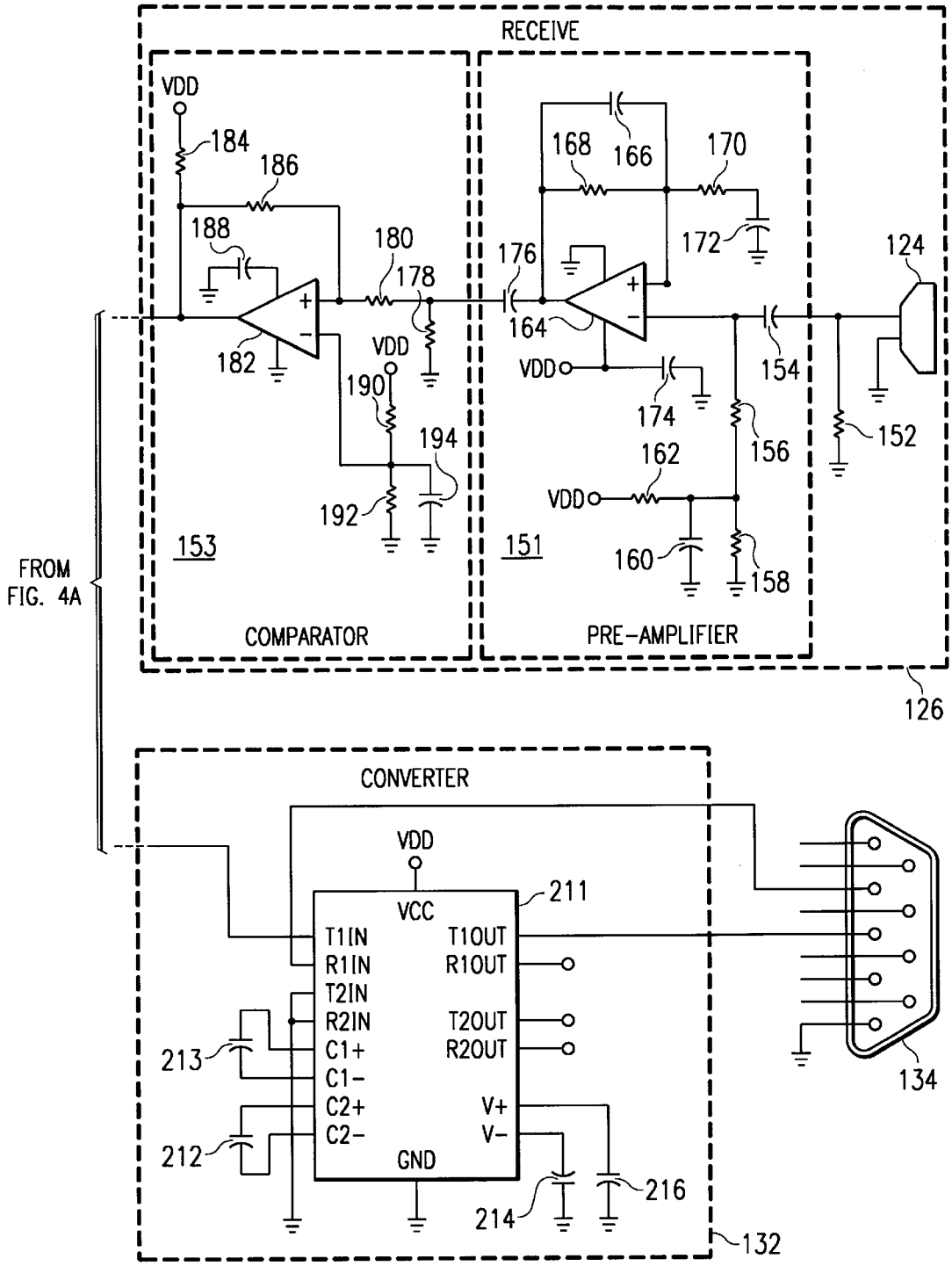

FIGS. 4A and 4B illustrate a schematic block diagram of an exemplary embodiment of a vehicle transducer unit 24. As shown, vehicle transducer unit 24 may include a microprocessor 118, a test circuit 120, an oscillator circuit 122, a power-up reset circuit 123, a receive circuit 126 having an ultrasonic transducer 124, a transmit circuit 128, a trigger circuit 130, a converter circuit 132, a port 134, a transmit/receive indicator circuit 136, and a power supply circuit 138.

Microprocessor 118 generally functions to control the operation of vehicle transducer unit 24. Microprocessor 118 may demodulate a signal received from a corresponding trailer transducer unit 22. Microprocessor 118 may also generate and output its own signals. In some cases, the generated signals can be in response to the received signals. Like microprocessor 37 of trailer transducer unit 22, microprocessor 118 may be implemented as an eight bit microprocessor, such as a model MC68HC705J1A manufactured by MOTOROLA. Microprocessor 118 may have an internal memory which stores operating software or data. The operating software can be run on microprocessor 118. A VSS input of microprocessor 118 is coupled to ground.

Test circuit 120 is coupled to a VDD input and an IRQ/VPP input of microprocessor 118. Test circuit 120 performs essentially the same function and may be implemented in substantially the same way as test circuit 38 shown and described above with reference to FIG. 3. Accordingly, test circuit 120 may include a resistor 140 and a capacitor 142.

Oscillator circuit 122 is coupled between an OSC1 and an OSC2 input of microprocessor 118. Oscillator circuit 122 may perform substantially the same function and be implemented in substantially the same way as oscillator circuit 40 shown and described in FIG. 3. Oscillator circuit 122 may include a piezoelectric crystal 144, resistor 146, and capacitors 148 and 150.

Power-up reset circuit 123 is coupled to a RESET input of microprocessor 118. Power-up reset circuit 123 performs essentially the same function and may be implemented in substantially the same way as power-up reset circuit 47 shown and described above with reference to FIG. 3. Power-up reset circuit 123 may include a resistor 145 and a capacitor 147.

Receive circuit 126 and transmit circuit 128 support bidirectional communication with a corresponding trailer transducer unit 22. Specifically, vehicle transducer unit 24 may be operable to receive input signals from and transmit output signals to such trailer transducer unit 22. Receive circuit 126 and transmit circuit 128 may also support ranging between the vehicle and another object. Transmit circuit 128 may be implemented in substantially the same way as transmit circuit 44 illustrated and described with reference to FIG. 3. Receive circuit 126 may comprise ultrasonic transducer 124, pre-amplifier circuit 151, and a comparator circuit 153.

Ultrasonic transducer 124 may be implemented as an acoustic transducer operating at forty kHz, seventy kHz, or any other suitable ultrasonic frequency. Ultrasonic transducer 124 functions to receive ultrasonic signals transmitted by a corresponding vehicle transducer unit 22. These ultrasonic signals are converted into electrical signals. One output of ultrasonic transducer 124 is coupled to ground. A resistor 152, which can have a value of 3.9 kΩ, may be coupled between the other output of ultrasonic transducer 124 and ground.

Pre-amplifier circuit 151 is coupled to ultrasonic transducer 124. Pre-amplifier 151 functions to amplify the electrical signal output by ultrasonic transducer 124. Pre-amplifier circuit 151 may have a gain of twenty. Pre-amplifier circuit 151 may toggle at a rate of forty kHz, seventy kHz, or any other suitable ultrasonic frequency for pre-amplification of the received signal. Pre-amplifier circuit 151 may be implemented as a capacitor 154, one end of which is coupled to an output of ultrasonic transducer 124. Capacitor 154 may have a value of 47 pF. One end of a resistor 156 is coupled to the other end of capacitor 154. Resistor 156 may have a value of 100 kΩ. A resistor 158 and a capacitor 160 are coupled in parallel between the other end of resistor 156 and ground. Resistor 158 and capacitor 160 may have values of 10 kΩ and 100 μF, respectively. A resistor 162, which may have a value of 10 kΩ is coupled between capacitor 160 and the voltage source. One input of an amplifier 164 is coupled to capacitor 154. The other input of amplifier 164 is coupled to the output of amplifier 164 via a feedback loop comprising a capacitor 166, a resistor 168, a resistor 170, and a capacitor 172. Exemplary values for these elements may be 33 pF, 100 kΩ, 4.99 kΩ, and 0.1 μF, respectively. A capacitor 174 is coupled to amplifier 164 and may have a value of 0.01 μF. A capacitor 176, which may have a value of 0.1 μF, is coupled to the output of amplifier 164.

Comparator circuit 153 is coupled between preamplifier circuit 151 and microprocessor 118. Comparator circuit 153 functions generally to "square up" or process the signal received/converted by ultrasonic transducer 124 and amplified by pre-amplifier circuit 151. Comparator circuit 153 may be implemented as follows. A resistor 178 is coupled between the output of pre-amplifier circuit 151 and ground. Resistor 178 may have a value of 1 kΩ. One end of a resistor 180 is coupled to the output of pre-amplifier circuit 151. The other end of resistor 180, which may have a value of 1 kΩ, is coupled to an input of an amplifier 182. This input of amplifier 182 is coupled to the amplifier's output via a feedback look comprising a resistor 184 and a resistor 186. Resistor 184 and resistor 186 may have values of 3 kΩ and 1MΩ, respectively. The output of amplifier 182 is coupled to a PA0 input of microprocessor 118. A capacitor 188 is coupled between amplifier 182 and ground. Capacitor 188 may have a value of 0.01 μF. A resistor 190, which may have a value of 100 kΩ, is coupled between the other input of amplifier 182 and the voltage source. A resistor 192 and a capacitor 194 are coupled in parallel between this input of amplifier 182 and ground. Resistor 192 may have a value of 1 kΩ.

Trigger circuit 130 performs substantially the same function as trigger circuit 42 shown and described above in FIG. 3. That is, trigger circuit 130 functions to "clean up" a trigger signal, such as brake signal, turn signal, or flashing signal, received from the seven-pin connector wiring of tractor 28. The trigger signal can be used to synchronize transmission/receipt of information between vehicle transducer unit 24 and a corresponding trailer transducer unit 22. Trigger circuit 130 may be implemented as a diode 196 coupled to the seven-pin connector wiring. One end of a resistor 198, which may have a value of 10 kΩ, is coupled to diode 196. Resistor 198, capacitor 200, and a resistor 202 are coupled in parallel between the other end of resistor 198 and ground. Capacitor 200 and resistor 202 may have values of 0.1 μF and 10 kΩ, respectively. The base of a transistor 204 is also coupled to resistor 198. The emitter of transistor 204 is coupled to ground. A switch 206 is coupled between ground and the collector of transistor 204. A resistor 208 is coupled between the voltage source and the collector of transistor 204. A capacitor 210 is coupled between the collector of transistor 204 and ground. Resistor 208 and capacitor 210 may have values of 10 kΩ and 0.1 μF, respectively. The output of trigger circuit 130 is coupled to a PA3 input of microprocessor 118.

Converter circuit 132 is coupled to a PA1 output of microprocessor 118. Converter circuit 132 generally functions to convert a signal output by microprocessor 118 into a suitable transmission format, such as an RS232 format. Converter circuit 132 can be a serial port. Converter circuit 132 may function to translate a five volt signal output by microprocessor 118 into the RS232 standard of a plus and minus nine volt signal. Converter 132 may comprise an RS232 level converter 211 implemented as an application specific integrated circuit (ASIC) having a plurality of inputs and outputs. A capacitor 213 is coupled between a C1+ and C1− input of RS232 level converter 211. A capacitor 213 is coupled between a C2+ and C2− input of RS232 level converter 211. Capacitor 213 and capacitor 212 may each have a value of 22 μF. A T2 IN and an R2 IN input of RS232 level converter 211 are coupled to ground. RS232 level converter 211 receives the five volt signal from microprocessor 118 over a T1 IN input. An R1 IN input of RS232 level converter 211 is coupled to a pin of a nine-pin port 134. A capacitor 214 and a capacitor 216 are coupled to V− and V+ inputs of RS232 level converter 211. Capacitors 214 and 216 may each have a value of 22 μF. A T1 OUT output may also be coupled to a pin of nine-pin port 134.

Transmit/receive indicator circuit 136 is coupled to a PA7 output of microprocessor 118. Transmit/receive indicator circuit 136 may be implemented and function in substantially the same manner as transmit/receive indicator circuit 46 illustrated and described above in FIG. 3. Transmit/receive indicator circuit 136 may comprise a resistor 218 and a light emitting diode 220.

Power supply circuit 138 may perform substantially the same function and be implemented in substantially the same way as power supply circuit 48 illustrated and described with reference to FIG. 3. Power supply circuit 138 may include connectors 222 and 224, capacitors 226 and 228, a voltage regulator 230, and capacitors 232 and 234.

Figure 5:
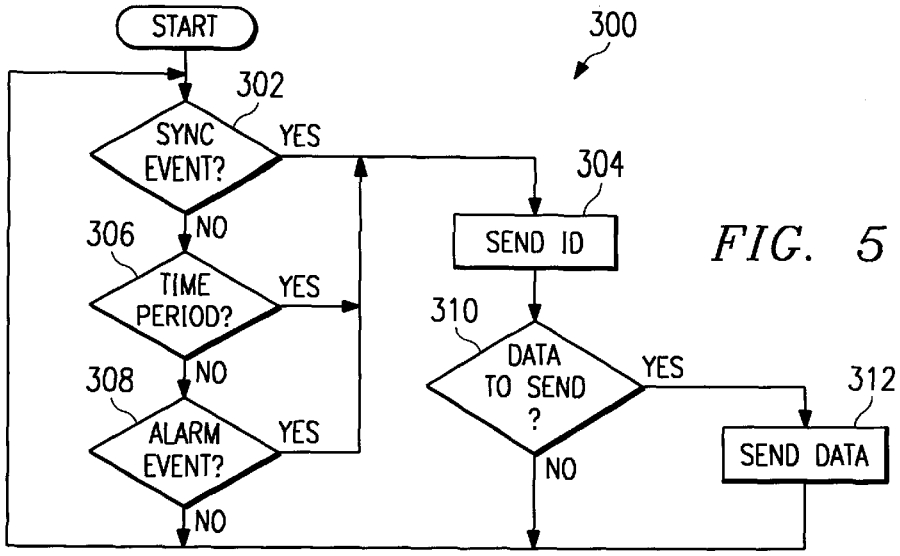
FIG. 5 is a flow diagram for communicating information from a trailer in accordance with the present invention.

FIG. 5 is a flow diagram of a method 300 for communicating information from a trailer 12 in accordance with the present invention. Method 300 corresponds to a simplified operation of a trailer transducer unit 22.

Method 300 begins at step 302 where microprocessor 37 of trailer transducer unit 22 determines whether a synchronization event has occurred. The synchronization event can be any event which may occur substantially simultaneously on both a trailer 12 and a vehicle. For example, the synchronization event may be a brake signal, a turn signal, or a flashing signal communicated over the seven-pin connector of trailer 12 and processed at trigger circuit 42.

If the synchronization event has occurred, microprocessor 37 transmits trailer identification information at step 304. Specifically, microprocessor 37 outputs this identification information as an electrical signal to transmit circuit 44. The transmit circuit 44 drives this information which is then converted into an acoustic signal by acoustic transponder 45. Acoustic transponder 45 transmits the acoustic signal preferably at an ultrasonic frequency. The trailer identification information can be unique to the trailer 12 on which trailer transducer unit 22 is located. The trailer identification information may comprise an alphanumeric code, ownership information, or any other suitable identification information. The identification information may be stored in the memory of microprocessor 37.

If no synchronization event has occurred at step 302, microprocessor 37 determines whether a time period has lapsed at step 306. The time period may comprise any interval of time, such as fifteen minutes, half of an hour, an hour, or the like, for which it is desirable to periodically report the status of conditions on trailer 12. A clock routine within microprocessor 37 may be used to time this interval. If the time period has lapsed, microprocessor 37 transmits the trailer identification at step 304.

If the time period has not lapsed, microprocessor 37 determines whether an alarm event has occurred at step 308. The alarm event may comprise any event, such as the opening of a door on trailer 12 or the violation of a critical level, for which it is desirable to alert an operator. If an alarm event has occurred, microprocessor 37 transmits a trailer identification at step 304. If no alarm event has occurred, microprocessor 37 returns to step 302 where it determines whether a synchronization event has occurred.

After transmitting a trailer identification at step 304, microprocessor 37 determines whether data should also be transmitted or sent at step 310. Such data may include status information relating to various conditions on trailer 12, such as humidity, temperature, shock, pressure, and the like. Microprocessor 37 may collect this data from sensors 39 and/or control unit 41. If no such data should be sent, microprocessor 37 returns to step 302. If there is data that should be sent, microprocessor 37 transmits the data at step 312. Transmission of data is accomplished in substantially the same manner as the transmission of identification information.

Figure 6:
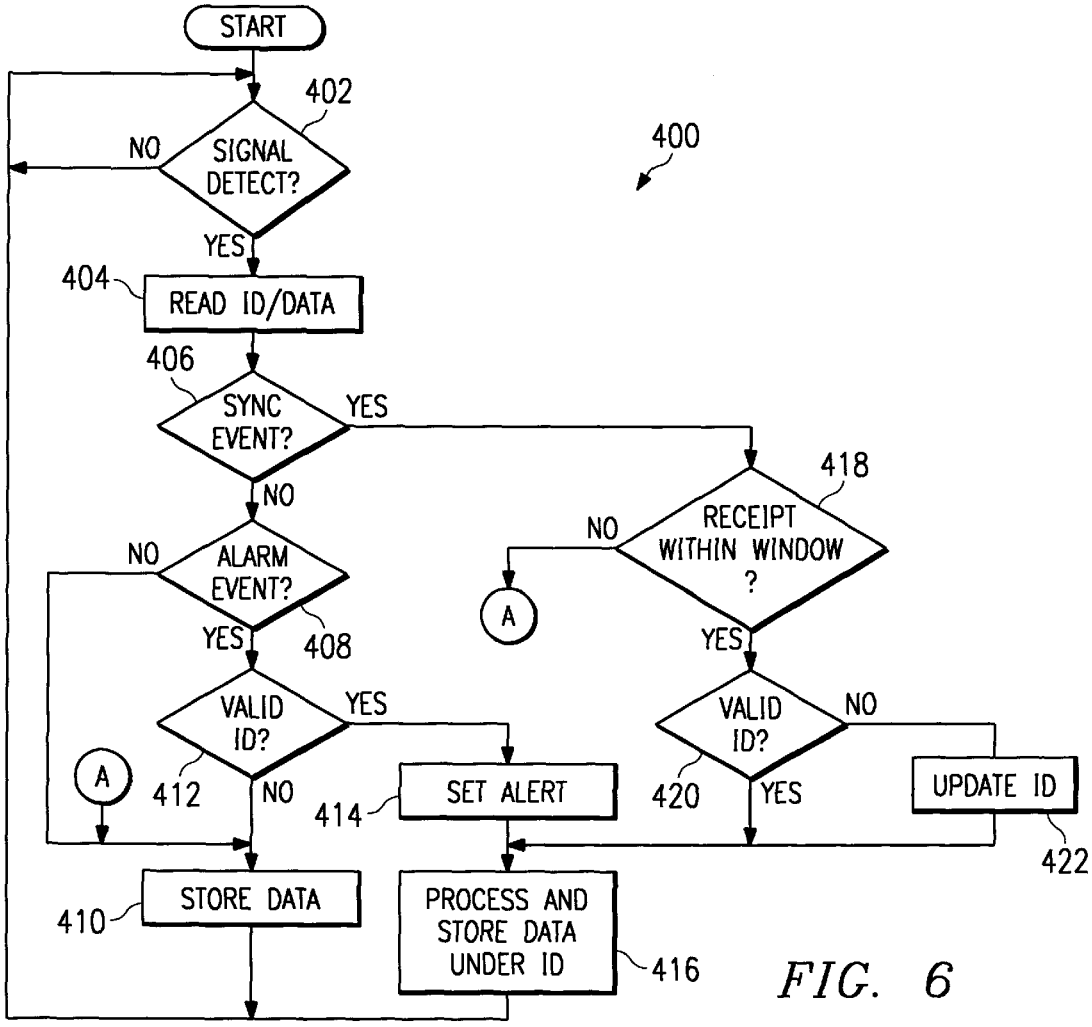
FIG. 6 is a flow diagram for receiving information at a vehicle in accordance with the present invention.

FIG. 6 is a flow diagram of a method 400 for receiving information at a vehicle in accordance with the present invention. Method 400 corresponds to the operation of vehicle transducer unit 24.

Method 400 begins at step 402 where microprocessor 118 of vehicle transducer unit 24 determines whether a signal has been detected at acoustic transducer 124. The detection of a signal is accomplished as follows. When acoustic transponder 124 receives a signal, transponder 124 converts the signal, which is then amplified at preamplifier circuit 151. Comparator circuit 153 "cleans up" the converted signal before it is input into microprocessor 118. If no signal has been detected, microprocessor 118 continues to monitor for a signal at step 402.

Upon detection of a signal at step 402, microprocessor 118 reads any trailer identification and other data conveyed within the signal at step 404. Microprocessor 118 determines whether a synchronization event has occurred at step 406. Such synchronization event may comprise a brake signal, a turn signal, a flashing signal, or the like received at trigger circuit 130 from the seven-pin connector wiring of the vehicle.

If no synchronization event has occurred, microprocessor 118 determines whether the data which has been read specifies an alarm event at step 408. If no alarm event is specified, there is a strong possibility that the received signal could be a spurious signal resulting from interference or crosstalk. Such a signal may contain information which is "invalid" in the sense that the information is not intended for receipt by this vehicle transducer unit 24. Accordingly, microprocessor 118 may store the data at step 410, but microprocessor 118 does not process such data as it would "valid" data. Microprocessor 118 then returns to step 402 where it monitors for the next signal detection.

Alternatively, if it is determined that an alarm event was specified at step 408, microprocessor 118 determines whether the received information specifies a valid trailer identification at step 412. This step of validating a trailer identification serves as a safeguard for the operation of vehicle transducer unit 24. If the information does not specify a valid trailer identification, microprocessor 118 stores, but does not process, the data at step 410, and then returns to step 402.

If the received information does specify a valid trailer identification at step 412, then microprocessor 118 may set an alert at step 414. The alert notifies an operator, such as a driver, about the alarm event which has occurred on trailer 12. The operator may then take appropriate action if necessary. Microprocessor 118 then processes and stores the data under the trailer identification at step 416, and then returns to step 402 where it monitors for the detection of a signal.

Referring again to step 406, if it is determined that a synchronization event has occurred, microprocessor 118 determines whether the signal was received within a predetermined window of time after the synchronization event at step 418. If not, the signal may be a spurious signal. Accordingly, microprocessor 118 may store the data contained within the signal at step 410, but does not process such data as valid data. Microprocessor 118 then monitors for the next signal detection at step 402.

If at step 418 it is determined that the signal was received within the predetermined window, microprocessor 118 determines whether a valid trailer identification is contained within the information conveyed in the signal at step 420. Because of the checks of steps 406 and 418, the signal is most likely a valid signal, but the identification may need to be updated, as in the case where the trailer 12 for the vehicle has been switched.

Accordingly, if the identification is not valid at step 420, microprocessor 118 updates the valid trailer identification at step 422. Microprocessor 118 may then use this trailer identification as the valid identification against which signals received in the future are compared. Microprocessor 118 processes the data contained within the signal and stores this data under the trailer identification at step 416. Microprocessor 118 then returns to step 402 where it monitors for the next signal detection.

Although the present invention has been described in several embodiments, a myriad of changes, variations, alterations, transformations, and modifications may be suggested to one skilled in the art, and it is intended that the present invention encompass such changes, variations, alterations, transformations, and modifications as fall within the spirit and scope of the appended claims.

What is claimed is:

1. A trailer communications system comprising:

a trailer transducer unit for location on a trailer;

a vehicle transducer unit for location on a vehicle; and the trailer transducer unit and the vehicle transducer unit operable to communicate information in the form of acoustic signals broadcast at an ultrasonic frequency in response to a predetermined event.

2. The system of claim 1, wherein the predetermined event comprises one of a synchronization event, an alarm event, or the lapse of a predetermined interval.

3. The system of claim 1, wherein the predetermined event comprises an event occurring on a seven-pin connector between the trailer and the vehicle.

4. The system of claim 1, further comprising at least one sensor located on the trailer and coupled to the trailer transducer unit, the sensor operable to monitor at least one of temperature, humidity, and pressure within the trailer.

5. The system of claim 1, further comprising at least one sensor located on the trailer and coupled to the trailer transducer unit, the sensor operable to detect an application of brakes on the trailer.

6. The system of claim 1, wherein the trailer transducer unit is further operable to support ranging between the trailer and another object.

7. The system of claim 1, wherein the trailer transducer unit comprises:

a trigger circuit operable to detect the predetermined event;

a microprocessor coupled to the trigger circuit, the microprocessor operable to generate an electrical signal in response to the predetermined event; and an ultrasonic transducer coupled to the microprocessor, the ultrasonic transducer operable to convert the electrical signal generated by the microprocessor into an acoustic signal, the ultrasonic transducer further operable to transmit the acoustic signal at an ultrasonic frequency.

8. The system of claim 7, wherein the trigger circuit is coupled to a seven-pin connector wiring of the trailer, the trigger circuit operable to detect at least one of a brake signal, a turn signal, and a flasher signal on the seven-pin connector wiring.

9. The system of claim 1, wherein the information communicated between the trailer transducer unit and the vehicle transducer unit comprises at least one of identification information, status information, alarm information, and control information.

10. The system of claim 1, further comprising a relay unit coupled to the vehicle transducer unit, the relay unit operable to relay the information communicated between the trailer transducer unit and the vehicle transducer unit to a host.

11. The system of claim 10, wherein the relay unit comprises a mobile positioning receiver operable to receive position determining information from a positioning system, the relay unit further operable to relay the position determining information to the host.

12. The system of claim 10, wherein the relay unit comprises an interface operable to display the information communicated between the trailer transducer unit and the vehicle transducer unit.

13. The system of claim 1, wherein the vehicle transducer unit comprises:

an ultrasonic transducer operable to receive an acoustic signal from the trailer transducer unit, the ultrasonic transducer further operable to convert the acoustic signal into an electrical signal; and a microprocessor coupled to the ultrasonic transducer, the microprocessor operable to receive and process the electrical signal.

14. The system of claim 1, further comprising a control unit on board the trailer and coupled to the trailer transducer unit, the control unit operable to adjust at least one of temperature, humidity, and pressure within the trailer.

15. The system of claim 1, wherein the trailer transducer unit and the vehicle transducer unit are each operable to transmit information in the form of acoustic signals.

16. The system of claim 1, wherein:

the predetermined event comprises a synchronization event occurring substantially simultaneously on the trailer and the vehicle; and the trailer transducer unit and the vehicle transducer unit detect the synchronization event.

17. The system of claim 1, wherein:

the predetermined event comprises a synchronization event;

the trailer transducer unit transmits information in response to the synchronization event; and the vehicle transducer unit receives the information and determines that the received information is valid if received within a predetermined window of time after the synchronization event.

18. A trailer communications system comprising:

a trailer transducer unit for location on a trailer, the trailer transducer unit operable to store trailer identification information uniquely identifying the trailer, the trailer transducer unit operable to transmit the trailer identification information in the form of an acoustic signal broadcast at an ultrasonic frequency in response to a predetermined event; and a vehicle transducer unit for location on a vehicle, the vehicle transducer unit operable to receive the trailer identification information transmitted by the trailer transducer unit.

19. The system of claim 18, further comprising a relay unit coupled to the vehicle transducer unit, the relay unit operable to relay the trailer identification information to a host.

20. The system of claim 18, wherein the trailer transducer unit is further operable to transmit at least one of status information and alarm information.

21. The system of claim 18, wherein:

the vehicle transducer unit is further operable to transmit control information in the form of an acoustic signal broadcast at ultrasonic frequency; and the trailer transducer unit is further operable to receive the control information transmitted by the vehicle transducer unit.

22. The system of claim 18, wherein the predetermined event comprises one of a synchronization event, an alarm event, or the lapse of a predetermined interval.

23. The system of claim 18, wherein the predetermined event comprises an event occurring on a seven-pin connector between the trailer and the vehicle.

24. The system of claim 18, wherein the vehicle transducer unit is further operable to transmit information in the form of acoustic signals.

25. The system of claim 18, wherein:

the predetermined event comprises a synchronization event occurring substantially simultaneously on the trailer and the vehicle; and the trailer transducer unit and the vehicle transducer unit detect the synchronization event.

26. The system of claim 18, wherein:

the predetermined event comprises a synchronization event;

the trailer transducer unit transmits information in response to the synchronization event; and the vehicle transducer unit receives the information and determines that the received information is valid if received within a predetermined window of time after the synchronization event.

27. A system for communication between a trailer and a vehicle, comprising:

a trailer transducer unit located on the trailer, the trailer transducer unit comprising:

a trigger circuit operable to detect a predetermined event;

a first microprocessor coupled to the trigger circuit, the first microprocessor operable to generate an electrical signal for conveying information in response to the detection of the predetermined event; and a first ultrasonic transducer coupled to the first microprocessor, the first ultrasonic transducer operable to convert the electrical signal generated by the first microprocessor into an acoustic signal, the first ultrasonic transducer operable to transmit the acoustic signal at an ultrasonic frequency; and a vehicle transducer unit located on the vehicle, the vehicle transducer unit comprising:

a second ultrasonic transducer operable to receive the acoustic signal transmitted by the first ultrasonic transducer of the trailer transducer unit, the second ultrasonic transducer further operable to convert the acoustic signal into an electrical signal; and a second microprocessor coupled to the second ultrasonic transducer, the second microprocessor operable to process the electrical signal from the second ultrasonic transducer to recover the information.

28. The system of claim 27, wherein the predetermined event comprises one of a synchronization event, an alarm event, or the lapse of a predetermined interval.

29. The system of claim 21, wherein the predetermined event comprises an event occurring on a seven-pin connector between the trailer and the vehicle.

30. The system of claim 27, wherein the second ultrasonic transducer is further operable to transmit information in the form of an acoustic signal.

31. The system of claim 27, wherein the vehicle transducer unit further comprises:

a second trigger circuit operable to detect the predetermined event; and the second microprocessor further operable to determine that the acoustic signal received by the second ultrasonic transducer is valid if received within a predetermined window of time after the predetermined event.

* * * * *